US008657470B2

(12) United States Patent
Jen et al.

(10) Patent No.: US 8,657,470 B2
(45) Date of Patent: Feb. 25, 2014

(54) LAMP STRUCTURE WITH ROTATABLE ADAPTER ELEMENTS

(75) Inventors: Hui-Feng Jen, New Taipei (TW); Che-Hsin Liao, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 247 days.

(21) Appl. No.: 13/311,547

(22) Filed: Dec. 6, 2011

(65) Prior Publication Data

US 2012/0230040 A1 Sep. 13, 2012

(30) Foreign Application Priority Data

Mar. 9, 2011 (TW) ..... 100107942 A

(51) Int. Cl.
*F21V 19/02* (2006.01)

(52) U.S. Cl.
USPC ..... 362/285; 362/269; 362/287; 362/294; 362/647; 362/249.07

(58) Field of Classification Search
USPC ..... 362/545, 548, 549, 647–659, 249.01, 362/249.02, 249.03, 249.07, 269, 285, 287, 362/800
See application file for complete search history.

(56) References Cited

U.S. PATENT DOCUMENTS

| | | | | |
|---|---|---|---|---|
| 823,000 | A * | 6/1906 | Snowhill et al. | 362/285 |
| 1,273,637 | A * | 7/1918 | Luth | 362/650 |
| 2,138,780 | A * | 11/1938 | Birdseye | 362/285 |
| 7,316,499 | B2 * | 1/2008 | Pazula | 362/650 |
| 8,072,123 | B1 * | 12/2011 | Han | 362/294 |
| 8,113,698 | B2 * | 2/2012 | Wu et al. | |
| 8,382,329 | B2 * | 2/2013 | Lutz et al. | 362/285 |
| 8,390,185 | B2 * | 3/2013 | Matsui et al. | 362/275 |
| 8,403,509 | B2 * | 3/2013 | Chin et al. | 362/269 |
| 8,419,241 | B2 * | 4/2013 | Jen et al. | 362/254 |
| 2012/0127734 | A1 * | 5/2012 | Tanimoto et al. | 362/363 |

FOREIGN PATENT DOCUMENTS

CN 201448662 5/2010

OTHER PUBLICATIONS

"Office Action of Taiwan counterpart application" issued on Mar. 29, 2013, p. 1-p. 4.

* cited by examiner

*Primary Examiner* — Ismael Negron
(74) *Attorney, Agent, or Firm* — Jianq Chyun IP Office

(57) ABSTRACT

A lamp structure includes a first adaptor, a second adaptor, an adaptor ring, a rotating element, a heat sink, and a lampshade. The second adaptor disposed in the first adaptor includes a cannular pivoting element and an assembly element. The assembly element disposed in the pivoting element has first arc openings symmetrically distributed around a center of the assembly element. The adaptor ring is disposed at a side of the second adaptor opposite the first adaptor. The rotating element fixed to a first surface of the adaptor ring that faces the second adaptor has a second surface facing the second adaptor and bosses extended from the second surface. The bosses respectively pass through the first arc openings to move along the first arc openings. The heat sink is disposed between the adaptor ring and the lampshade.

8 Claims, 6 Drawing Sheets

LAMP STRUCTURE WITH ROTATABLE ADAPTER ELEMENTS

CROSS-REFERENCE TO RELATED APPLICATION

This application claims the priority benefit of Taiwan application serial no. 100107942, filed on Mar. 9, 2011. The entirety of the above-mentioned patent application is hereby incorporated by reference herein and made a part of this specification.

BACKGROUND OF THE INVENTION

1. Field of the Invention

The invention generally relates to a lamp structure, and more particularly, to a lamp structure with adjustable illumination direction.

2. Description of Related Art

Light emitted by lamps used for some special purposes, such as interior design, decoration, and exhibition, is usually directional. In such a lamp, a directional light source or a lampshade for blocking light in a specific direction may be installed. When such a lamp is installed to a lamp holder, the limited illumination direction thereof may not meet the requirement of the installer. Thus, to adjust the illumination direction of the lamp, the lamp has to be dismounted from the lamp holder to adjust the initial position thereof relative to the lamp holder and then re-installed back to the lamp holder.

SUMMARY OF THE INVENTION

Accordingly, the invention is directed to a lamp structure with adjustable illumination direction, wherein unlike a conventional lamp structure with directional illumination, the illumination direction of the lamp structure in the invention can be conveniently adjusted.

The invention provides a lamp structure with adjustable illumination direction. The lamp structure is suitable for being installed to a lamp holder and includes a first adaptor, a second adaptor, an adaptor ring, a rotating element, a heat sink, and a lampshade. The first adaptor is suitable for being installed to the lamp holder. The second adaptor is disposed in the first adaptor and includes a pivoting element and an assembly element. The pivoting element presents a cannular shape. The assembly element is disposed in the pivoting element to separate the pivoting element into a first portion and a second portion. The assembly element has a plurality of first arc openings, wherein the first arc openings are symmetrically distributed around a center of the assembly element. The adaptor ring is disposed at a side of the second adaptor that is relatively farther away from the first adaptor. The rotating element is fixed to a first surface of the adaptor ring that faces the second adaptor. The rotating element has a second surface facing the second adaptor and a plurality of bosses extended from the second surface towards the second adaptor. The bosses respectively pass through the first arc openings of the second adaptor and are suitable for moving along a profile of the first arc openings. The heat sink is pivoted to the adaptor ring and located at a side of the adaptor ring that is relatively farther away from the second adaptor. The lampshade is disposed at a side of the heat sink that is relatively farther away from the first adaptor.

According to an embodiment of the invention, in the lamp structure with adjustable illumination direction, the ends of the bosses that are extended towards the second adaptor are clasps.

According to an embodiment of the invention, the lamp structure with adjustable illumination direction further includes a plurality of first locking elements, wherein the first locking elements are respectively fixed to the ends of the bosses that are extended towards the second adaptor, and the assembly element of the second adaptor is located between the first locking elements and the second surface of the rotating element. The first locking elements may be screws or C-rings. When the first locking elements are screws, the external diameter of screw heads of the screws is greater than the caliber of the first arc openings in a radial direction of the assembly element. When the first locking elements are C-rings, the external diameter of the C-rings is greater than the caliber of the first arc openings in a radial direction of the assembly element.

According to an embodiment of the invention, in the lamp structure with adjustable illumination direction, each of the first arc openings has a plurality of segments, and each of the bosses is respectively located in one of the segments of the first arc openings.

According to an embodiment of the invention, the lamp structure with adjustable illumination direction further includes a lubricating film disposed between the second adaptor and the rotating element, wherein the lubricating film has a plurality of second arc openings, and the shapes of the second arc openings are corresponding to those of the first arc openings.

As described above, in a lamp structure with adjustable illumination direction provided by the invention, the illumination direction can be adjusted by moving the bosses of a rotating element along the first arc openings of an assembly element of a second adaptor. Thereby, the lamp structure provided by the invention is more convenient to use than a conventional lamp structure.

These and other exemplary embodiments, features, aspects, and advantages of the invention will be described and become more apparent from the detailed description of exemplary embodiments when read in conjunction with accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
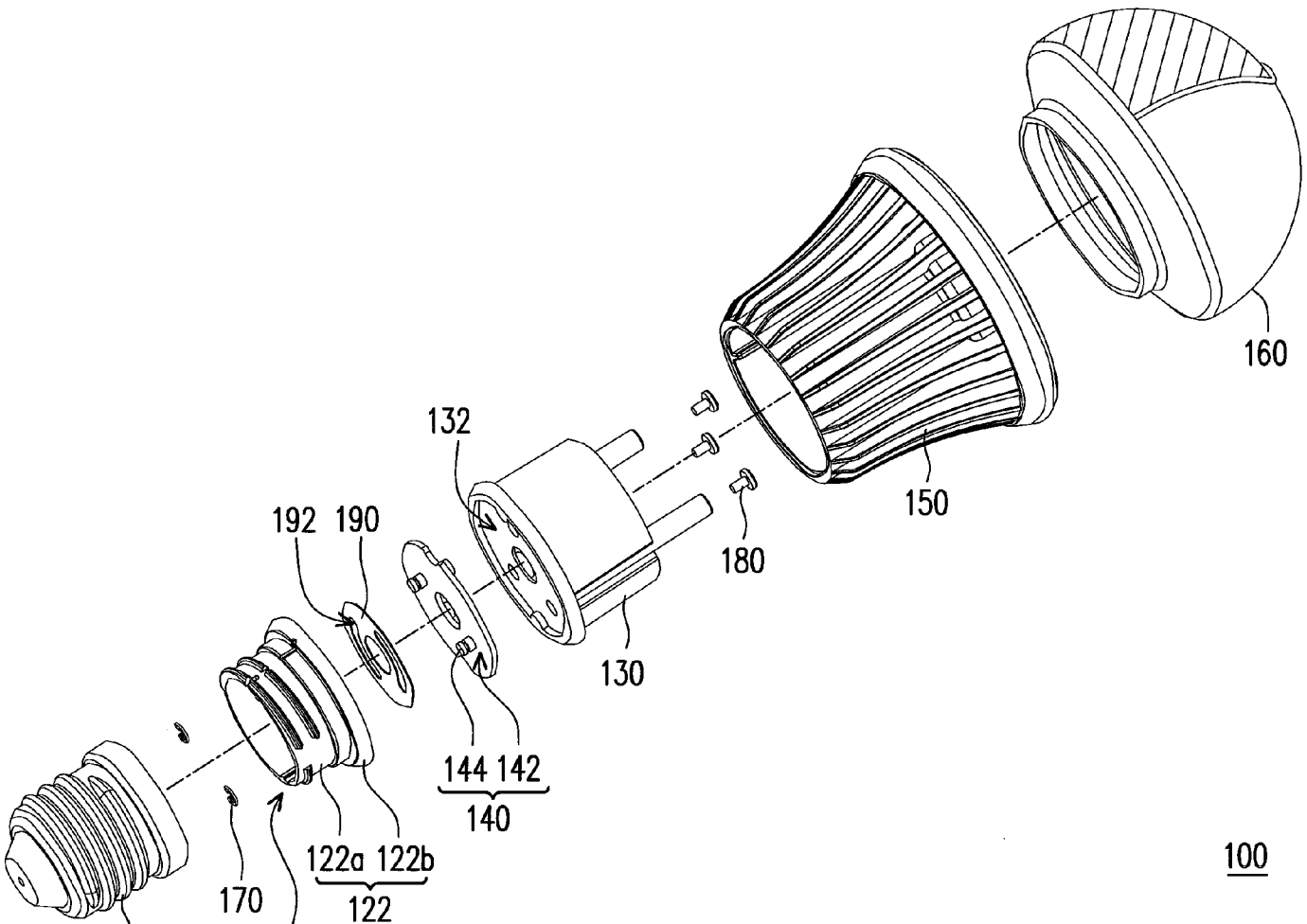
FIG. 1 is an explosion diagram of a lamp structure with adjustable illumination direction according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
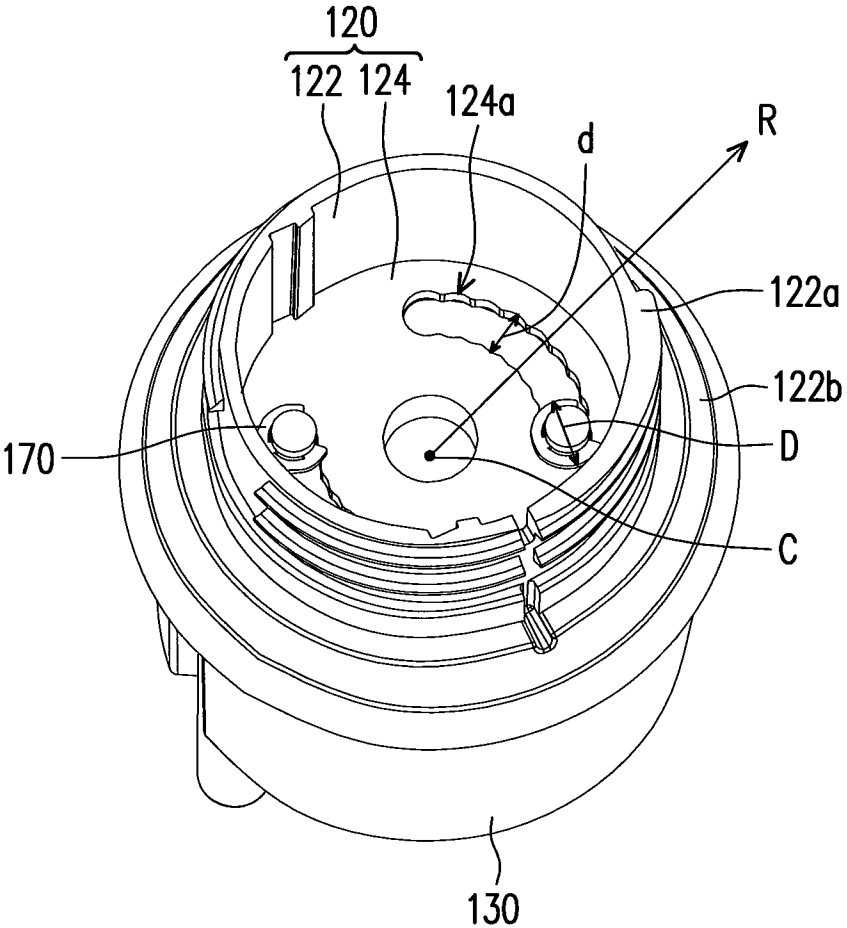
FIG. 2 is a diagram illustrating a second adaptor, a rotating element, and an adaptor ring in FIG. 1 that are assembled together.

FIG. 1 is an explosion diagram of a lamp structure with adjustable illumination direction according to an embodiment of the invention, and FIG. 2 is a diagram illustrating a second adaptor, a rotating element, and an adaptor ring in FIG. 1 that are assembled together. Referring to both FIG. 1 and FIG. 2, the lamp structure 100 with adjustable illumination direction in the present embodiment is suitable for being installed to a lamp holder (not shown). The lamp structure 100 with adjustable illumination direction includes a first adaptor 110, a second adaptor 120, an adaptor ring 130, a rotating element 140, a heat sink 150, and a lampshade 160. The first adaptor 110 is suitable for being installed to the lamp holder. The second adaptor 120 is disposed in the first adaptor 110 and includes a pivoting element 122 and an assembly element 124. The pivoting element 122 presents a cannular shape. The assembly element 124 is disposed in the pivoting element 122 to separate the pivoting element 122 into a first portion 122*a* and a second portion 122*b*. The assembly element 124 has a plurality of first arc openings 124*a*. In the present embodiment, there is a pair of first arc openings 124*a*, and the first arc openings 124*a* are symmetrically distributed around a center C of the assembly element 124. The adaptor ring 130 is disposed at a side of the second adaptor 120 that is relatively farther away from the first adaptor 110. The rotating element 140 is fixed to a first surface 132 of the adaptor ring 130 that faces the second adaptor 120. The rotating element 140 has a second surface 142 facing the second adaptor 120 and a plurality of bosses 144 extended from the second surface 142 towards the second adaptor 120. The bosses 144 respectively pass through the first arc openings 124*a* of the second adaptor 120 and are suitable for moving along a profile of the first arc openings 124*a*. The heat sink 150 is pivoted to the adaptor ring 130 and located at a side of the adaptor ring 130 that is relatively farther away from the second adaptor 120. The lampshade 160 is disposed at a side of the heat sink 150 that is relatively farther away from the first adaptor 110.

In addition, the lamp structure 100 with adjustable illumination direction may further include a plurality of first locking elements 170. After the bosses 144 respectively pass through the first arc openings 124*a*, the first locking elements 170 are respectively fixed to the ends of the bosses 144 that are extended towards the second adaptor 120. Herein the assembly element 124 of the second adaptor 120 is located between the first locking elements 170 and the second surface 142 of the rotating element 140, and the second adaptor 120 is assembled with the rotating element 140. In the present embodiment, the first locking elements 170 are C-rings, and the external diameter D of each C-ring is greater than the caliber d of each first arc opening 124*a* in the radial direction R of the assembly element 124. In addition, each boss 144 can be designed to have a neck such that the C-ring can be conveniently locked to the boss 144, wherein the diameter of the neck is smaller than that of any other portion of the boss 144 so that the C-ring can be conveniently locked to the neck.

Figure 3:
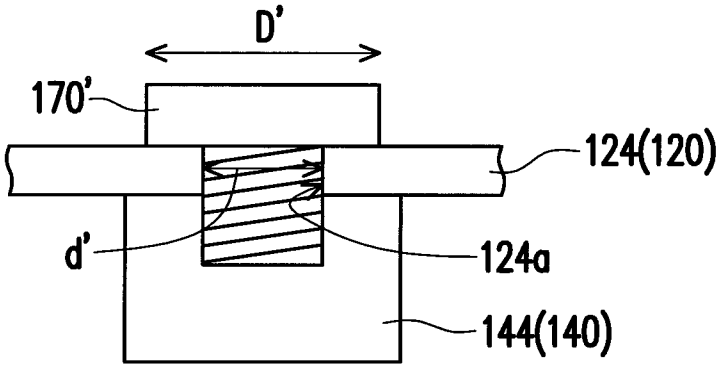
FIG. 3 is a diagram illustrating first locking elements, a rotating element, and bosses according to another embodiment of the invention.

FIG. 3 is a diagram illustrating first locking elements, a rotating element, and bosses according to another embodiment of the invention. Referring to FIG. 3, in the present embodiment, the first locking elements 170' are screws, and the external diameter D' of the screw head of each screw is greater than the caliber d' of each first arc opening 124*a* in the radial direction R (as shown in FIG. 2) of the assembly element 124 so that the second adaptor 120 and the rotating element 140 can also be assembled together. As described above, how the second adaptor 120 and the rotating element 140 are assembled together is not limited in the invention but can be determined according to the actual requirement.

Figure 4:
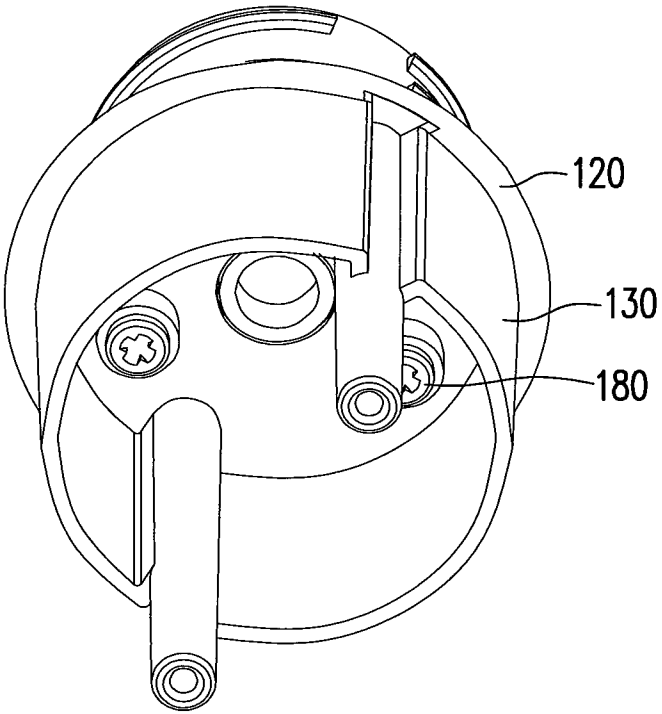
FIG. 4 is a diagram illustrating the elements in FIG. 2 from another visual angle.

FIG. 4 is a diagram illustrating the elements in FIG. 2 from another visual angle. Referring to both FIG. 1 and FIG. 4, in the present embodiment, the lamp structure 100 with adjustable illumination direction further includes a plurality of second locking elements 180. The second locking elements 180 pass through the adaptor ring 130 and are respectively locked into the rotating element 140 to fix the rotating element 140 onto the adaptor ring 130.

When the lamp structure 100 illustrated in FIG. 1 is assembled onto a lamp holder (not shown), because a specific portion of the lampshade 160 of the lamp structure 100 in the present embodiment is opaque, the illumination of the lamp structure 100 is directional (i.e., the lamp structure 100 can only emit light in a specific direction). If the specific illumination direction does not meet the requirement of a user (for example, the user wants a downward illumination direction but when the lamp structure 100 is installed to the lamp holder, the opaque portion of the lampshade 160 of the lamp structure 100 is located at the down side so that the lamp structure 100 emits light upwards), the user may hold and rotate the heat sink 150 (which has a large surface area therefore is easy to hold) with his/her hand, so that the bosses 144 of the rotating element 140 fixed onto the adaptor ring 130 can move along the profile of the first arc openings 124*a* and the position of the lampshade 160 can be adjusted. Accordingly, the illumination direction of the lamp structure 100 can be changed.

The illumination directivity of the lamp structure 100 is explained above with the position of the lampshade 160. However, in other embodiments, a directional light source may also be applied to the lamp structure 100 with adjustable illumination direction.

To be specific, each first arc opening 124*a* may further have a plurality of segments, and each boss 144 may be respectively located in one of the segments of the first arc openings 124*a*, so as to allow the user to sense that the bosses 144 of the rotating element 140 move along the profile of the first arc openings 124*a* and to fix the positions of the bosses 144 of the rotating element 140 in the first arc openings 124*a*. In the present embodiment, the first arc openings 124*a* may be a plurality of circular openings that are connected with each other in series, and the segments are formed along with the first arc openings 124*a*.

Figure 5:
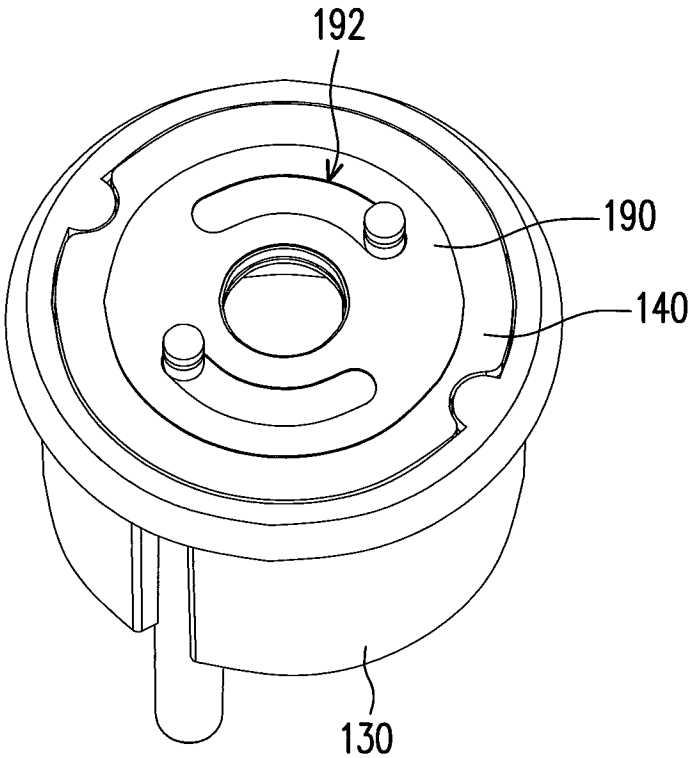
FIG. 5 is a diagram illustrating a lubricating film, a rotating element, and an adaptor ring that are assembled together.

FIG. 5 is a diagram illustrating a lubricating film, a rotating element, and an adaptor ring that are assembled together. Referring to both FIG. 1 and FIG. 5, the second adaptor 120 may be made of plastic, and the rotating element 140 may be made of plastic or metal. When the rotating element 140 moves relative to the second adaptor 120, the friction between the rotating element 140 and the second adaptor 120 may not only cause disturbing sound but wear out the opposing surfaces of the rotating element 140 and the second adaptor 120. Thus, in the present embodiment, a lubricating film 190 is further disposed between the second adaptor 120 and the rotating element 140. The lubricating film 190 has a plurality of second arc openings 192. The second arc openings 192 have shapes and positions corresponding to those of the first arc openings 124*a*, and the bosses 144 respectively pass through the second arc openings 192. The disposition of the lubricating film 190 allows the second adaptor 120 and the rotating element 140 to rotate relative to each other smoothly and prevents the opposing surfaces of the rotating element 140 and the second adaptor 120 from being worn out.

Figure 6:
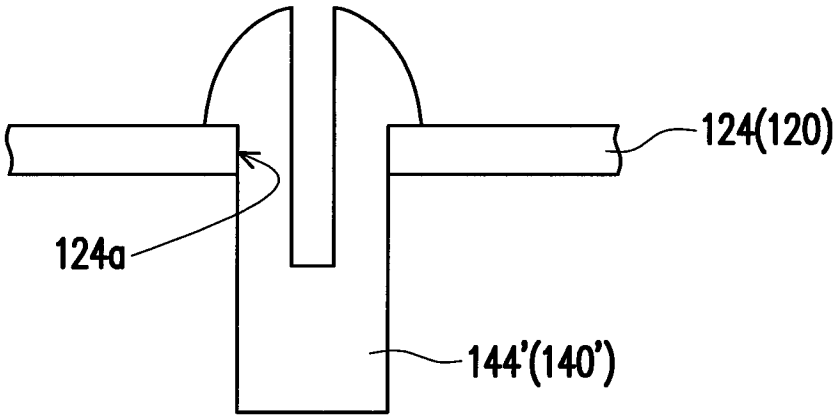
FIG. 6 is a diagram illustrating another implementation of bosses.

FIG. 6 is a diagram illustrating another implementation of bosses. Referring to FIG. 6, in another embodiment, the ends of the bosses 144' may also be clasps. The clasps are extended towards the second adaptor 120 and can conveniently and respectively pass through the first arc openings 124*a* of the assembly element 124 of the second adaptor 120. The second adaptor 120 and the rotating element 140' can be conveniently assembled or disassembled by designing the ends of the bosses 144' into clasps.

In summary, the invention provides a lamp structure with adjustable illumination direction, wherein bosses are disposed on a rotating element and arc openings are disposed on an assembly element of a second adaptor so that the bosses of the rotating element can move along the first arc openings of the assembly element of the second adaptor and accordingly the illumination direction can be conveniently adjusted. Compared to the conventional lamp structure in which the initial assembly position has to be adjusted by dismounting the lamp structure from the lamp holder, the lamp structure with adjustable illumination direction provided by the invention is more convenient to use.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A lamp structure with adjustable illumination direction, configured to be coupled to a lamp holder, the lamp structure comprising:

a first adaptor, configured to be coupled to the lamp holder;

a second adaptor, disposed in the first adaptor, the second adaptor comprising:

a pivoting element, having a cannular shape; and an assembly element, disposed in the pivoting element to separate the pivoting element into a first portion and a second portion, the assembly element having a plurality of first arc openings, wherein the first arc openings are symmetrically distributed around a center of the assembly element;

an adaptor ring, disposed at a side of the second adaptor opposite the first adaptor;

a rotating element, fixed to a first surface of the adaptor ring facing the second adaptor, the rotating element having a second surface facing the second adaptor and a plurality of bosses extending from the second surface towards the second adaptor, wherein the bosses respectively pass through the first arc openings of the second adaptor and are configured to move within the first arc openings;

a heat sink, rotatably secured to the adaptor ring and located at a side of the adaptor ring opposite the second adaptor; and a lampshade, disposed at a side of the heat sink opposite the first adaptor.

2. The lamp structure according to claim 1, wherein the ends of the bosses extending towards the second adaptor are clasps.

3. The lamp structure according to claim 1, wherein each of the first arc openings has a plurality of segments, and each of the bosses is respectively located in one of the segments of the first arc openings.

4. The lamp structure according to claim 1 further comprising a lubricating film disposed between the second adaptor and the rotating element, wherein the lubricating film has a plurality of second arc openings, and shapes of the second arc openings correspond to shapes of the first arc openings.

5. The lamp structure according to claim 1 further comprising a plurality of first locking elements, wherein the first locking elements are respectively fixed to the ends of the bosses extending towards the second adaptor, and the assembly element of the second adaptor is located between the first locking elements and the second surface of the rotating element.

6. The lamp structure according to claim 5, wherein the first locking elements are screws or C-rings.

7. The lamp structure according to claim 6, wherein when the first locking elements are screws, and an external diameter of screw heads of the screws is greater than a width of the first arc openings in a radial direction of the assembly element.

8. The lamp structure according to claim 6, wherein when the first locking elements are C-rings, and an external diameter of the C-rings is greater than a width of the first arc openings in a radial direction of the assembly element.

* * * * *